US006498569B2

(12) United States Patent
Dijkstra

(10) Patent No.: US 6,498,569 B2
(45) Date of Patent: Dec. 24, 2002

(54) TRAFFIC INFORMATION ANALYZER SYSTEM

(76) Inventor: Patrick Dijkstra, Elzenlaan 4, 3465TJ Driebruggen (NL)

( * ) Notice: Subject to any disclaimer, the term of this patent is extended or adjusted under 35 U.S.C. 154(b) by 8 days.

(21) Appl. No.: 09/759,482

(22) Filed: Jan. 12, 2001

(65) Prior Publication Data

US 2002/0093432 A1 Jul. 18, 2002

(51) Int. Cl.[7] ..... G08G 1/00
(52) U.S. Cl. ..... 340/901; 340/902; 342/20
(58) Field of Search ..... 340/901, 902, 340/906, 904, 995, 439; 701/210; 342/20

(56) References Cited

U.S. PATENT DOCUMENTS 4,952,931 A * 8/1990 Serageldin ..... 340/902
5,187,476 A * 2/1993 Hamer ..... 340/906
5,250,951 A * 10/1993 Valentine ..... 340/506
5,850,193 A * 12/1998 Shimoura ..... 340/995
5,977,884 A * 11/1999 Ross ..... 340/936

* cited by examiner

*Primary Examiner*—Anh La

(57) ABSTRACT

A traffic information analyzing system comprising (a) a receiver adapted to receive signals from police and other sources; (b) a location tracking receiver adapted to convert locations into coordinate and directional information so it may be tracked and stored and analyzed; (c) a user interface allowing a user to input information into the system corresponding to locations where a user considers that a received signal is undesired, the user interface also adapted to output information including an alarm or warning message to a user; and (d) a processing unit adapted to receive inputs from the receiver and location tracking system, the processing unit also adapted to receive and relay data with respect to the user interface, the processing unit also being able to determine and register the location of undesired signals whereby the processing unit informs the system when an undesirable signal is detected.

8 Claims, 2 Drawing Sheets

TRAFFIC INFORMATION ANALYZER SYSTEM

BACKGROUND OF THE INVENTION

1. Field of the Invention

The present invention relates to a traffic information analyzer system and more particularly pertains to discriminating between signals from police sources and signals from other sources.

2. Description of the Prior Art

The use of signal receivers of known designs and configurations are known in the prior art. More specifically, signal receivers previously devised and utilized for the purpose of discerning signals are known to consist basically of familiar, expected and obvious structural configurations, notwithstanding the myriad of designs encompassed by the crowded prior art which has been developed for the fulfillment of countless objectives and requirements.

By way of example, U.S. Pat. No. 5,977,884 to Ross discloses a radar detector responsive to vehicle speed. Additionally, Japaneese Patent Number JP09027096 to Shinichi discloses a speed excess alarming device. The subject matter of these patents is incorporated herein by reference.

While these devices fulfill their respective, particular objectives and requirements, the aforementioned patents do not describe a traffic information analyzer system that allows for discriminating between signals from police sources and signals from other sources.

In this respect, the traffic information analyzer system according to the present invention substantially departs from the conventional concepts and designs of the prior art, and in doing so provides an apparatus primarily developed for the purpose of discriminating between signals from police sources and signals from other sources.

Therefore, it can be appreciated that there exists a continuing need for a traffic information analyzer system which can be used for discriminating between signals from police sources and signals from other sources. In this regard, the present invention substantially fulfills this need.

SUMMARY OF THE INVENTION

In view of the foregoing disadvantages inherent in the known types of signal receivers now present in the prior art, the present invention provides an improved traffic information analyzer system. As such, the general purpose of the present invention, which will be described subsequently in greater detail, is to provide a traffic information analyzer system and method which has all the advantages of the prior art and none of the disadvantages.

To attain this, the present invention essentially comprises a traffic information analyzer system and method adapted to discriminate between signals from police sources and signals from other sources comprising, in combination, a microwave receiver adapted to receive and analyze signals from microwave sources including means to demodulate the detected signals. Such signals adapted to be demodulated include amplitude modulation, frequency modulation, phase modulation and other analog and digital modulation schemes. The microwave receiver also includes output means to the detected signals. The system also includes an optical receiver adapted to receive and analyze signals from optical sources including means to demodulate the detected signals. Such signals adapted to be demodulated include amplitude modulation, frequency modulation, phase modulation and other analog and digital modulation schemes. The optical receiver also includes an output means to relay the detected signals. The system also includes a location and direction tracking receiver selected from the class of location and direction tracking receivers including G.P.S. and LORAN. The location and direction tracking receiver is adapted to convert locations into coordinate and directional information so it may be tracked, stored, and analyzed. The location and direction tracking receiver also includes an output means to relay the coordinate and directional information. The system also includes a load data base interface allowing the system to input and update stored data and information from external sources including data and information such as maps and data of the locations where predetermined extraneous signals are located as well as a predetermined maximum speed for mapped areas. The load data base interface also includes output means to relay the data and information. The system also includes a speed determining input means adapted to determine the speed at which a vehicle equipped with the system is traveling. The speed determining input means is of the class of speed determining input means including speedometers and G.P.S. trackers. The speed determining input means also includes an output to relay speed information. The system also includes a user interface including an output means adapted to allow a user to input information into the system corresponding to a location where a user considers that a received reading is from an extraneous source and also adapted to allow a user to input information into the system corresponding to a location where a user considers that special driving care is required. The user interface also includes a visual display and speaker adapted to generate information to a user in response to a received signal and an alarm to inform a user that a signal from a police source has been detected and also that a location requiring special care is being approached. The user interface also has means to display an alarm signal and means to signify the perception of an extraneous signal. Lastly, the system includes a processing and storage unit adapted to receive inputs from the microwave receiver, optical receiver, location tracking receiver, load data base interface and speed determining input means. The processing and storage unit is also adapted to receive and relay data with the user interface. The processing and storage unit is also adapted to analyze received signals to determine which received signals are within and not within the allocated band widths of governmental guidelines. The processing and storage unit is also adapted to determine and register data relating to the location and frequency and number and strength of extraneous signals with the extraneous signal data adapted to be collected when a user activates the user interface to record the extraneous signal data after a user interprets the received signal to be an undesired signal from one or more of the receivers and with the processor and storage unit recalling loaded extraneous signal data from the processor and storage unit. The processing and storage unit is also adapted to delete registered data relating to extraneous signals when a user activates the user interface to delete such previously registered data. The processor and storage unit is also adapted to inform, and where appropriate ignore, the system from notifying a user that an extraneous signal at a prerecorded frequency is detected at its associated location where such a signal was decided to be extraneous either by a user or preloaded data. The processing unit is also adapted to determine the number of signals at a specific location and the frequencies of the detected signals as well as the strength and frequency thereof. The processor and storage unit is further adapted to disengage or alter the alarm when a user is traveling at a speed under a predetermined maximum speed.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a traffic information analyzer system which has all of the advantages of the prior art and none of the disadvantages.

It is another object of the present invention to provide a traffic information analyzer system which may be easily and efficiently manufactured, marketed and used.

It is further object of the present invention to provide a traffic information analyzer system which is of durable and reliable constructions.

Even still another object of the present invention is to provide a traffic information analyzer system and more particularly pertains to discriminating between signals from police sources and signals from other sources.

Lastly, it is an object of the present invention to provide a traffic information analyzing system comprising (a) a receiver adapted to receive signals from police and other sources; (b) a location tracking receiver adapted to convert locations into coordinate and directional information so it may be tracked and stored and analyzed; (c) a user interface allowing a user to input information into the system corresponding to locations where a user considers that a received signal is from an extraneous source, the user interface also adapted to output information including an a message to a user; and (d) a processing unit adapted to receive inputs from the receiver and location tracking system, the processing unit also adapted to receive and relay data with respect to the user interface, the processing unit also being able to determine and register the location of an extraneous signal whereby the processing unit disables or alters the message when an extraneous signal is detected.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
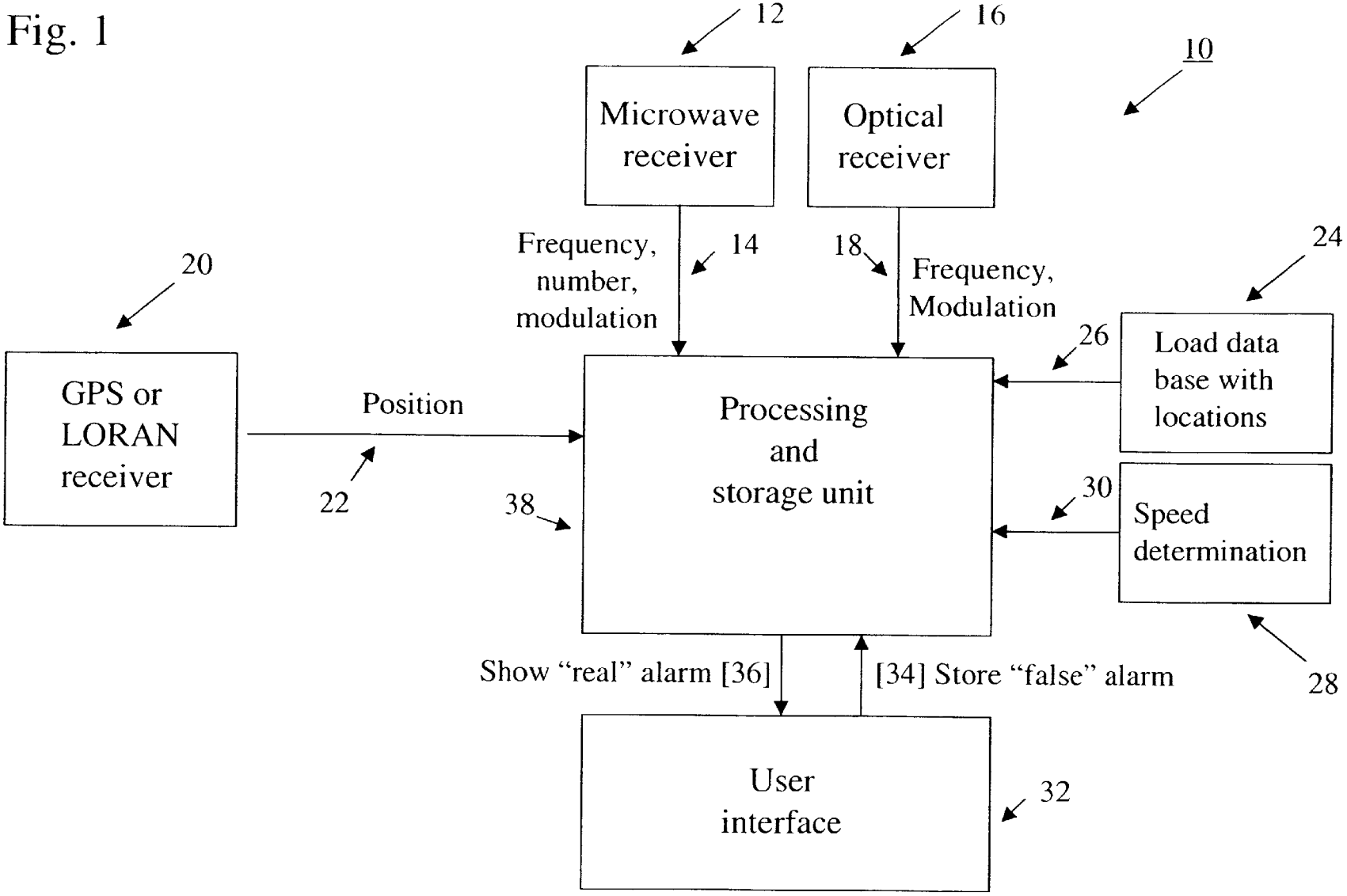
FIG. 1 is a block diagram of the primary embodiment of the present invention.
Figure 2:
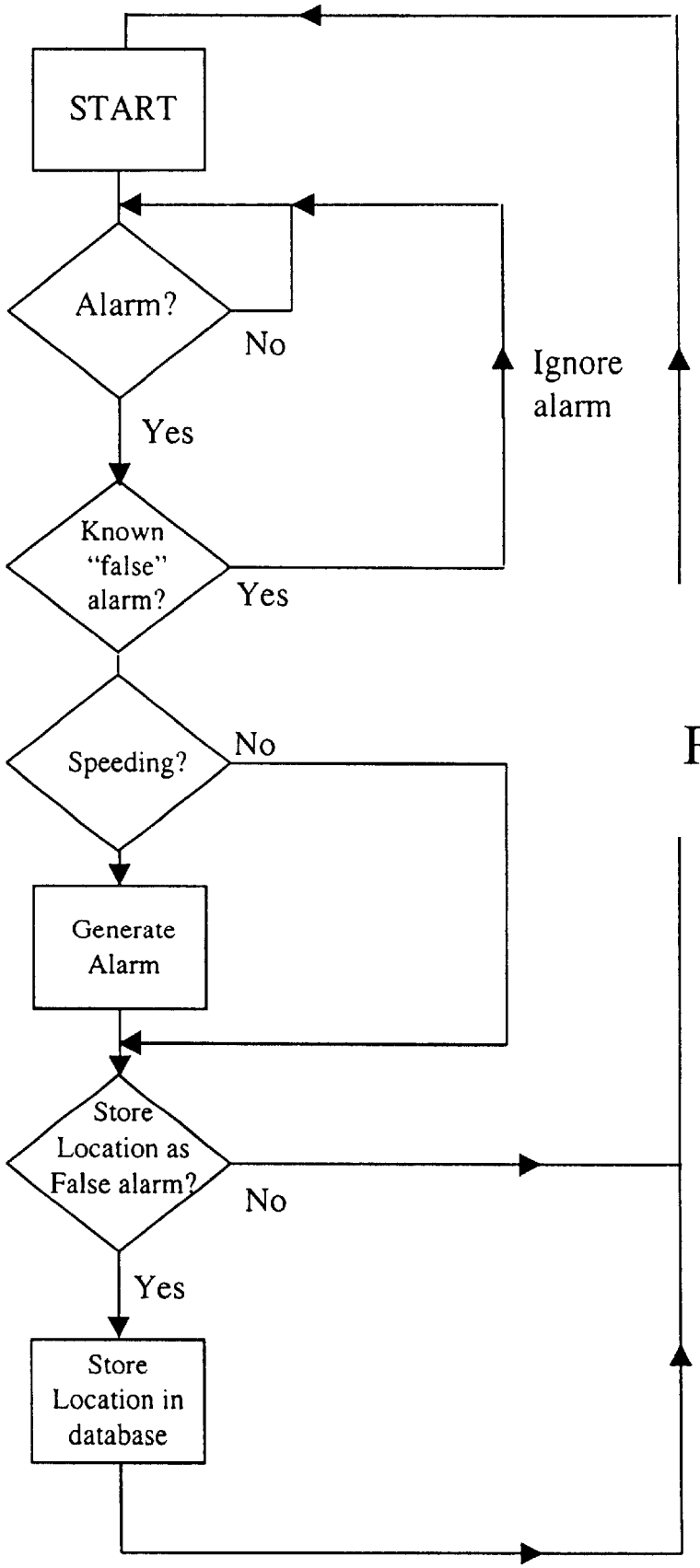
FIG. 2 is a flow diagram of the method steps associated with the present invention.

With reference now to the drawings, and in particular to FIG. 1 thereof, the preferred embodiment of the traffic information analyzer system embodying the principles and concepts of the present invention and generally designated by the reference numeral 10 will be described.

As will be described in greater detail hereinafter, the present system is adapted to receive input and to analyze the received input and then to generate output in response thereto. The input includes various types including signals from police sources, and undesired signals from extraneous sources, and signals from non-extraneous sources such as warning or commercial messages, and global positioning system (G.P.S.) information, and speed information, and user generated data either provided on a case by case basis by a user or provided en masse through a load data base. The output includes various types including audio messages such as beeping alarms, and/or graphic/text messages on a display panel and/or an audio/verbal messages through a speaker.

The present invention, the traffic information analyzer system 10 is comprised of a plurality of components. Such components in their broadest context include (a) receivers; (b) a location tracking receiver; (c) a user interface; and (d) a processing unit. Such components are individually configured and correlated with respect to each other so as to attain the desired objective.

The traffic information analyzer system 10 is adapted to discriminate between signals from police sources and signals from other sources. It comprises, in combination, a microwave receiver 12 which is adapted to receive and analyze microwave signals, such as radar signals, from external sources. It includes means to demodulate the detected signals. These signals that are able to be demodulated include amplitude modulation, frequency modulation, phase modulation and other analog and digital modulation schemes. The microwave receiver also includes an output means 14 to relay the detected signals.

Next provided is an optical receiver 16 which is adapted to receive and analyze optical signals, such as laser signals, from external sources. It includes means to demodulate the detected signals. These signal that are able to be demodulated include amplitude modulation, frequency modulation, phase modulation and other analog and digital modulation schemes. The optical receiver also includes an output means 18 to relay the detected signals.

A location and direction tracking receiver 20 is next provided. Such receiver is selected from the class of location tracking receivers including G.P.S. and LORAN. Such receiver is adapted to convert locations into coordinate and directional information so it may be tracked and stored and analyzed. The location and direction and tracking receiver further has an output means 22 to relay the coordinate and directional information.

Next provided is a load data base interface 24 which functions to allow the system to input and update stored data and information from external sources. Such data and information includes information such as maps and data of the locations where predetermined extraneous signals are located as well as the a predetermined maximum speed for mapped areas and the like. The load data base interface also includes an output means 26 for the data and information.

A speed determining input means 28 is also provided and is adapted to determine the speed at which a vehicle equipped with the system is traveling. The speed determining input means is of the class of speed determining input means including speedometers and G.P.S. trackers. The speed detection input means also has an output means 30 to relay the current speed of the vehicle.

Additionally provided is a user interface 32. Such user interface includes an output means 34 which functions to allow a user to input information into the system corresponding to locations where the user considers that a received reading is extraneous. The user interface also provides the ability to input key locations where a user wishes an additional alarm to sound. This is done in association with the G.P.S. When for example an area requiring extra driving care is being approached, it is beneficial for the driver to be warned as by a warning message. Typical of such areas is a school or hospital zone. Another area is the location of a speed sensor of the induction loop variety. Such sensors are described, for example, in U.S. Pat. No. 4,368,428 issued Jan. 11, 1983 to Dijkman and in U.S. Pat. No. 5,041,828 issued Aug. 20, 1991 to Loeren. The subject matter of these patents is incorporated herein by reference. For the induction loop locations, as well as for some other key locations, a direction of travel can also be provided and input into the data base. These areas which require extra driving care, as well as the direction of travel when appropriate, may be individually provided to the data base of the system by the user on a case by case basis. Such key locations and, when desired, the direction of travel, may also be input into the data base en masse. In addition, the data base may be provided with a predetermined distance from the key locations when the alarm may be sounded. Lastly, any of these key locations may also be deleted by the user as the need for a warning is no longer desired.

Such user interface also includes an input means 36 which allows output information to a user such as the detection of signals. The user interface also includes a visual display and speaker adapted to generate information to a user in response to a received signal. The user interface also includes a message warning to inform a user that a signal from a police source has been detected or that a location requiring special driving care is being approached. The user interface has means to display an alarm signal and a means to signify the perception of an extraneous signal. This interface would include a button to allow the user to store frequency and location and number and strength of a signal which the user perceives as extraneous as well as a power switch.

Lastly provided is a processing and storage unit 38 which is adapted to receive inputs from the microwave receiver, optical receiver, location tracking receiver, load data base interface and speed determining input means. The processing and storage unit is also adapted to receive and relay data with the user interface. The processing and storage unit is also adapted to analyze received signals to determine which received signals are within and not within the allocated band widths of governmental guidelines. The processing and storage unit is able to determine and register data relating to the location and frequency and number and strength of extraneous signals with the extraneous signal data also adapted to be collected when a user activates the user interface to record the extraneous signal data after a user interprets the received signal to be an undesired signal from one or more of the receivers. The processing and storage unit also functions to recall loaded extraneous signal data from the storage unit. The processing and storage unit is also adapted to delete registered data relating to extraneous signals when a user activates the user interface to delete such previously registered data. The processing and storage unit also disables the alarm from notifying a user that a signal at a prerecorded frequency is detected at its associated location where such a signal was decided to be undesired either by a user or preloaded data. The processing and storage unit also is able to determine the number of signals at a specific location and the frequencies of the detected signal as well as the frequency and strength of such signal. The processing and storage unit is further adapted to disable or otherwise alter the alarm when a user is traveling at a speed under a predetermined maximum speed whenever a police signal is detected. Additionally, the processing and storage unit is adapted to prioritize information and, where appropriate, to ignore or alter data relating to the location of an undesired signal and activate the alarm or warning message if a user is traveling at a speed over a predetermined maximum speed and a police signal is detected.

Also associated with the system of the present invention is a method of analyzing traffic information to discriminate between signals from police sources and signals from other sources. The method includes the following steps:

1. Providing: a) a signal detection.and alarm system with a start component and starting the system, b) an alarm determining component, c) a known undesired alarm determining component, d) a speed determining component, e) an alarm generator component, f) a determining component for storing locations of undesired alarms, and g) a component for storing the location of undesired alarms in the database.

2. The next step of the method is determining at the alarm determining component when a signal is received and creating a first signal to the known undesired alarm determining component when a signal is received and creating an alternate signal to in advance of the alarm determining component to ignore or alter the alarm when no signal is received.

3. The next step is comparing the first signal to the stored locations of extraneous signals in the known undesired alarm determining component and generating a second signal if the signal does not match a stored location of extraneous signals and creating an alternate signal to in advance of the alarm determining component to ignore or alter the alarm when the location from the first signal matches the location of a known undesired alarm location.

4. The next step is generating an alarm at the alarm generator component in response to the second signal and generating a third signal in response thereto.

5. The next step is determining whether the vehicle is exceeding a predetermined maximum speed by the speed determining component and generating a fourth signal in response thereto for inactivating the alarm generating component if the vehicle is not exceeding a predetermined maximum speed.

6. The next step is determining the location of undesired alarms from signals generated by other than police sources at the determining component for storing locations of undesired alarms and generating a fifth signal in response thereto and creating an alternate signal to in advance of the start component to ignore or alter the alarm when a known extraneous signal is received.

7. The next step is storing such locations of known undesired alarms from the fifth signal in the component for storing the location of undesired alarms in the database.

8. The final step is to generate a sixth signal from the component for storing the location of undesired alarms in the database and feeding such signal back to in advance of the start component to thereby suppress undesired alarms or warning messages from signals generated by other that police sources.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation. shown and described, and accordingly, all suitable modifications and equivalents may be resorted to, falling within the scope of the invention.

What is claimed as being new and desired to be protected by Letters Patent of the United States is as follows:

1. A traffic information analyzer system adapted to discriminate between signals from police sources and signals from other sources comprising, in combination;

a microwave receiver adapted to receive and analyze microwave signals from sources including means to demodulate the received signals, the signals adapted to be demodulated including amplitude modulation, frequency modulation, phase modulation and other analog and digital modulation schemes, the microwave receiver also including output means to relay the detected signals;

an optical receiver adapted to receive and analyze optical signals from optical sources including means to demodulate the detected signals, the signals adapted to be demodulated including amplitude modulation, frequency modulation, phase modulation and other analog and digital modulation schemes, the optical receiver also including an output means to relay the detected signals;

a location and direction tracking receiver selected from the class of location and direction tracking receivers including G.P.S. and LORAN, the location and direction tracking receiver adapted to convert locations into coordinate and directional information so it may be tracked and stored and analyzed, the location and direction tracking receiver also including an output means to relay the coordinate and directional information;

a load data base interface allowing the system to input and update stored data and information from external sources including data and information including maps and data of the locations where predetermined extraneous signals are located as well as a predetermined maximum speed from mapped areas and also including output means to relay the data information;

a speed determining input means adapted to determine the speed at which a vehicle equipped with the system is traveling, the speed determining input means being of the class of speed determining input means including speedometers and G.P.S. tracker and also including an output to relay speed information;

a user interface including an output means adapted to allow a user to input information into the system corresponding to locations where a user considers that a received reading is extraneous and also adapted to allow a user to input information into the system corresponding to locations where a user considers that special driving care is required, the user interface also including a visual display and speaker adapted to generate information to a user in response to a received signal and an alarm to inform a user that a signal from a police source has been detected or that a location requiring special driving care is being approached, the user interface also having means to display an alarm signal and means to signify the perception of an extraneous signal; and a processing and storage unit adapted to receive inputs from the microwave receiver, optical receiver, location tracking receiver, load data base interface and speed determining input means, the processing and storage unit also adapted to receive and relay data with the user interface, the processing and storage unit also adapted to analyze received signals to determine which received signals are within and not within the allocated band widths of governmental guidelines, the processing and storage unit also adapted to determine and register data relating to the location and frequency and number and strength of extraneous signals with the extraneous signal data adapted to be collected when a user activates the user interface to record the extraneous signal data after a user interprets the received signal to be an undesired signal from one or more of the receivers with the processor and storage unit recalling loaded extraneous signal data from the processor and storage unit, the processing and storage unit also adapted to delete registered data relating to extraneous signals when a user activates the user interface to delete such previously registered data, the processor and storage unit also adapted to disable the alarm from notifying a user that an extraneous signal at a prerecorded frequency is detected at its associated location where such a signal was decided to be extraneous either by a user or preloaded data, the processing unit also adapted to determine the number of signals at a specific location and the frequencies of the detected signals and the frequency and strength thereof, the processor and storage unit further adapted to disable the alarm when a user is traveling at a speed under the predetermined maximum speed.

2. A traffic information analyzing system comprising;

a receiver adapted to receive signals from the class of signals which includes radio frequency signals, infrared signals and microwave signals, the signals being from police sources and other sources;

a location tracking receiver adapted to convert locations into coordinated information so it may be tracked and stored and analyzed;

a user interface allowing a user to input information regarding locations which are known by the user to have a large number of output sources which combine to generate a signal which causes an alarm condition within the system, with the user interface also allowing the user to determine and set parameters within which an alarm would be generated by the system; and a processing unit adapted to receive inputs from the receiver and location tracking system, the processing unit also adapted to receive and relay data with respect to the user interface, the processing unit also being able to determine and register and store the location of extraneous signals, the stored location being based on information which is inputted by the user, with the processing unit disabling or bypassing the alarm or warning message when such an extraneous signal is detected.

3. The system as set forth in claim 2 including a user interface allowing a user to input information, wherein the receiver is a microwave receiver.

4. The system as set forth in claim 2 a including a user interface allowing a user to input information, wherein the receiver is an optical receiver.

5. The system as set forth in claim 2 including a user interface allowing a user to input information, and further including a speed determining input means adapted to determine the speed at which a vehicle equipped with the system is traveling and to inactivate the alarm if the vehicle is not exceeding the predetermined maximum speed.

6. The system as set forth in claim 2 including a user interface allowing a user to input information, and further including a load data interface allowing the system to input and update stored data from the class of external sources which includes maps and data of locations where predetermined undesired signals are located.

7. The system as set forth in claim 2 including a user interface allowing a user to input information, including means to allow a user to input information into the system corresponding to locations where a user considers that special driving care is required.

8. A method of receiving signals from desired sources and generating alarms or warning messages in response thereto while suppressing undesired signals generated by other than desired sources comprising, in combination:

providing an incoming signal detection and message system and starting the system;

providing a message determining component;

providing a known undesired signal determining component;

providing a speed determining component;

providing a message generator component;

providing a determining component for storing locations of undesired signals;

providing a component for storing locations of undesired signals in the database;

determining at the message determining component when incoming signals are received and creating first signals to the known undesired message determining component when an incoming signals are received;

comparing the first signals to the stored locations of undesired signals in the known undesired signal determining component and generating second signals if the incoming signals do not match stored locations of the undesired signals;

generating a message at the message generator component in response to the second signal and generating a third signal in response thereto;

determining whether the vehicle is exceeding a predetermined maximum speed by the speed determining component and generating fourth signals in response thereto for informing the message generating component if the vehicle is not exceeding the predetermined maximum speed;

determining the location of undesired signals from signals generated by other than police sources at the determining component for storing locations of undesired signals and generate fifth signals in response thereto;

storing such locations of known undesired signals from the fifth signals in the component for storing the location of undesired signals in the database; and generating sixth signals from the component for storing the location of undesired messages in the database and feeding such signals back to thereby suppress undesired alarms or warning messages from signals generated by other than police sources.

* * * * *